US008649718B2

(12) United States Patent
Shimoda

(10) Patent No.: US 8,649,718 B2
(45) Date of Patent: Feb. 11, 2014

(54) APPARATUS AND METHOD OF COLOR SHIFT CORRECTION, AND MEDIUM STORING COLOR SHIFT CORRECTION PROGRAM

(75) Inventor: Junichi Shimoda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 405 days.

(21) Appl. No.: 13/167,726

(22) Filed: Jun. 24, 2011

(65) Prior Publication Data

US 2011/0318065 A1 Dec. 29, 2011

(30) Foreign Application Priority Data

Jun. 29, 2010 (JP) ..... 2010-148046

(51) Int. Cl.
*G03G 15/01* (2006.01)

(52) U.S. Cl.
USPC ..... 399/301

(58) Field of Classification Search
USPC ..... 399/301, 49
See application file for complete search history.

(56) References Cited

U.S. PATENT DOCUMENTS

| | | | | |
|---|---|---|---|---|
| 7,343,110 | B2 * | 3/2008 | Sakamoto | 399/44 |
| 2006/0263120 | A1 * | 11/2006 | Hayakawa | 399/301 |
| 2007/0122210 | A1 * | 5/2007 | Sato et al. | 399/301 |
| 2007/0223974 | A1 * | 9/2007 | Kunimori | 399/301 |

FOREIGN PATENT DOCUMENTS

JP 2008-233410 A 10/2008

OTHER PUBLICATIONS

Patent Abstracts of Japan, English language Abstract for JP-2008-233410, Oct. 2, 2008, 1 page, Japan Patent Office.

* cited by examiner

*Primary Examiner* — Walter L Lindsay, Jr.
*Assistant Examiner* — Rodney Bonnette
(74) *Attorney, Agent, or Firm* — Harness, Dickey & Pierce, P.L.C.

(57) ABSTRACT

An apparatus forms a plurality of patterns using a plurality of colors as a second pattern, and a plurality of patterns using one of the plurality of colors as a second pattern. The apparatus obtains a first detection result indicating the pitch of each one of the plurality of patterns of the first pattern, and a second detection result indicating the pitch of each one of the plurality of patterns of the second pattern. The apparatus calculates a difference between the first detection result and the second detection result to obtain a difference value, and calculates a correction value using the second detection result and the difference value. The correction value is used to control an image forming apparatus to suppress color shifts in the images.

12 Claims, 8 Drawing Sheets

APPARATUS AND METHOD OF COLOR SHIFT CORRECTION, AND MEDIUM STORING COLOR SHIFT CORRECTION PROGRAM

CROSS-REFERENCE TO RELATED APPLICATIONS

This patent application is based on and claims priority under 35 U.S.C. §119 to Japanese Patent Application No. 2010-148046, filed on Jun. 29, 2010, in the Japanese Patent Office, the entire disclosure of which is hereby incorporated herein by reference.

FIELD OF THE INVENTION

The present invention generally relates to an apparatus and a method of correcting color shifts in an image forming apparatus, and a recording medium storing a program of correcting color shifts in an image forming apparatus.

BACKGROUND

The tandem color image forming apparatuses form images on the surfaces of a plurality of photoconductors, and transfer the images from the photoconductors to an image carrier so as to form a full-color image by superimposing the images one above the other. For improved image quality, the tandem color image forming apparatuses form a color toner patterns of respective colors, and detect a pitch between the toner patterns using an optical sensor to calculate the shifts due to registration displacement in main and scanning directions, magnification error, skew, distortion, etc. The calculated results are used to feedback control various image forming conditions to suppress the color shift. The above-described color shift correction is usually performed when the power of the image forming apparatuses are turned on, when environmental factors such as temperature change, or when a predetermined number of pages are printed.

While the color shift correction is necessary to improve image quality, formation of color toner patterns would increase the overall toner consumption. In order to reduce toner consumption required for color shift correction, Japanese Patent Application Publication No. 2008-233410 describes an image forming apparatus that makes a width of the color toner pattern to be smaller when the color shift correction is successfully performed.

SUMMARY

The image forming apparatus of Japanese Patent Application Publication No. 2008-233410 still requires the use of color toner for the purpose of color shift correction. Since color toner cartridges are usually priced higher than black toner cartridges, the inventor of the present invention has realized that there is a need for greatly suppressing the use of color toner for color shift correction.

In view of the above, example embodiments of the present invention include an apparatus, method, system, computer program and product each capable of: forming a plurality of patterns using a plurality of colors as a second pattern, a plurality of patterns using one of the plurality of colors as a second pattern; obtaining a first detection result indicating the pitch of each one of the plurality of patterns of the first pattern, and a second detection result indicating the pitch of each one of the plurality of patterns of the second pattern; calculating a difference between the first detection result and the second detection result to obtain a difference value, and calculating a correction value using the second detection result and the difference value. The correction value is used to control the image forming apparatus to suppress color shifts in the images.

Assuming that the one of the plurality of colors is black, color toner consumption otherwise required for color shift correction is greatly reduced. Alternatively, in case when the user desires to use toner of a specific color rather than black toner, the one of the plurality of colors may be determined according to user preference.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
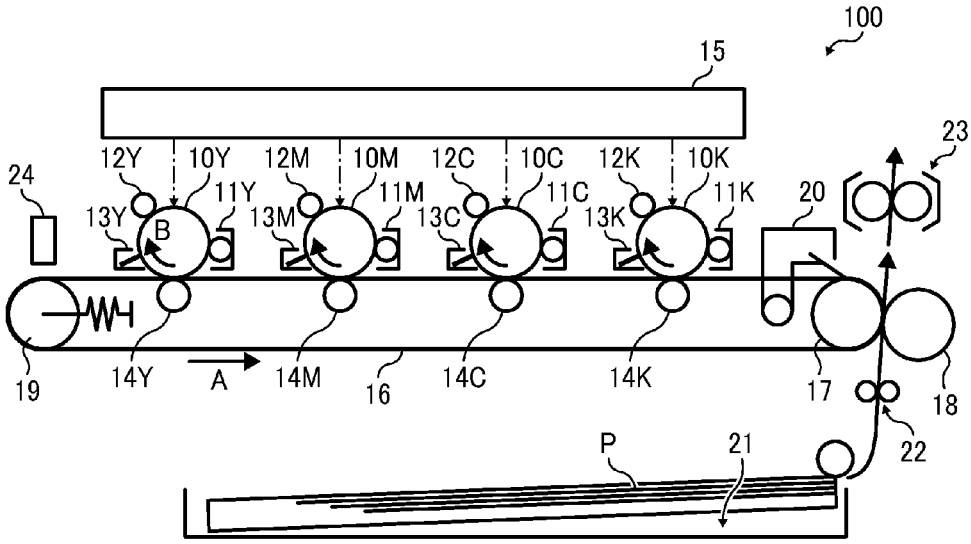
FIG. 1 is a cross-sectional view illustrating an image forming device of intermediate transfer type, which may be included in a color image forming apparatus, according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner. In the following examples, a structure and operation of image forming apparatus are explained, which is capable of correcting color shifts using mainly a black toner pattern such that the use of color toner is reduced.

FIG. 1 illustrates a structure of a color image forming device 100, which forms a color image using electrophotographic method. The color image forming device 100 is provided in an image forming apparatus. The color image forming device 100 of FIG. 1 is a tandem image forming device of intermediate transfer type, which transfers images of four colors that are respectively formed on the surfaces of photoconductors onto the surface of an intermediate transfer body one above the other to form a full-color image thereon, and further transfers the full-color image onto a recording medium. In the following examples, the intermediate transfer body, which functions as an image carrier, is implemented by an intermediate transfer belt 16. In addition to the intermediate transfer belt 16, the image forming device 100 may be provided with a transfer belt, which may also function as the image carrier. Further, the recording medium, which may be a recording sheet, transfer sheet, or OHP sheet, is referred to as a transfer sheet for the descriptive purposes.

Referring to FIG. 1, the image forming device 100 includes four photoconductive drums 10Y, 10M, 10C, and 10K provided for the respective colors of yellow (Y), magenta (M), cyan (C), and black (K), four developing devices 11Y, 11M, 11C, and 11K, and the intermediate transfer belt 16. The developing devices 11Y, 11M, 11C, and 11K, which may be collectively referred to as the developing device 11, develop the latent images formed on the surfaces of the photoconductive drums 10Y, 10M, 10C, and 10K into toner images of Y, M, C, and K. The intermediate transfer belt 16 is an endless belt, which is rotated in the direction indicated by the arrow A. As the intermediate transfer belt 16 is rotated, the toner images of respective colors that are formed on the surfaces of the photoconductors 10Y, 10M, 10C, and 10K are superimposed one above the other to form a full-color image on the intermediate transfer belt 16. This transferring of images is called a primary transfer process. Above the intermediate transfer belt 16, the photoconductive drums 10K, 10C, 10M, and 10Y are arranged side by side along the direction of rotation of the intermediate transfer belt 16. Above the photoconductive drums 10, an exposure device 15 is provided.

The image forming unit is provided for each of the colors Y, M, C, and K, which includes a charger 12 (12Y, 12M, 12C, and 12K), the developing device 11, a primary transfer roller 14 (14Y, 14M, 14C, and 14K) and a cleaner 13 (13Y, 13M, 13C, and 13K), which are provided in the circumferential direction of the photoconductive drum 10. The photoconductive drum 10 is rotated in the direction indicated by the arrow B. As it rotates, the surface of the photoconductive drum 10 is uniformly charged by the charger 12 to a predetermined polarity. The exposure device 15 irradiates a light beam, such as laser beam, onto the charged surface of the photoconductive drum 10 to form a latent image thereon. The developing device 11 develops the latent image into toner image with toner of a specific color.

The primary transfer roller 14, which is rotated, is provided at a poison that faces the photoconductive drum 10 via the intermediate transfer belt 16. The intermediate transfer belt 16 is supported by a drive roller 17 and a tension roller 19. While the transfer belt 16 may be stretched by a plurality of rollers, in this example, the intermediate transfer belt 16 is stretched by two points of the drive roller 17 and the tension roller 19, thus making the size of the image forming device compact. This results in reducing the overall height of the image forming device 100. The toner image formed on the surface of the photoconductive drum 10 is transferred to the surface of the intermediate transfer belt 16 by electric charge supplied to the primary transfer roller 14. In this manner, the toner images of K, C, M, and Y are superimposed one above the other to form a full-color toner image on the surface of the intermediate transfer belt 16.

The image forming device 100 further includes a secondary transfer roller 18, which is provided at a position that faces the drive roller 17 via the intermediate transfer belt 16. After the transfer sheet P is fed from a sheet feed unit 21, a registration roller pair 22 is rotated at a predetermined timing so as to transfer the transfer sheet P to a nip formed between the drive roller 17 and the secondary transfer roller 18. The full-color image formed on the intermediate transfer belt 16 is transferred to the transfer sheet P by the secondary transfer roller 18. For this reasons, in this example, the drive roller 17 functions as a secondary transfer roller.

The toner image formed on the transfer sheet P is further transferred to a fixing device 23. At the fixing device 23, the full-color toner image is fixed to the transfer sheet P by heat and pressure. The transfer sheet P having the full-color image thereon is discharged onto a sheet discharge tray.

After the secondary image transfer process, a cleaner 20 removes residual toner that resides on the surface of the intermediate transfer belt 16. The image forming device 100 further includes a reflective sensor 24, which is provided at a predetermined position so a to keep a predetermined distance with respect to the intermediate transfer belt 16.

In case of tandem-type color image forming device, image density of each color toner image should be made uniform to have the full-color toner image of high image quality. To control image density, the image forming device 100 forms a reference toner pattern on the image carrier, such as the intermediate transfer belt 16 or the transfer belt, which indicates a reference image density. The reflective sensor 24 optically detects a density of the toner pattern. The detected density is used to feedback control various image forming conditions that may influence the image density such as charging potential, exposed light intensity, developing bias voltage, transfer voltage, and toner supply. In the tandem color image forming apparatuses, the color shift may be caused in the full-color image due to an error in installation of various devices, error in adjusting parameters for the exposure device such as exposure light level, deformation, environmental and temporal changes, fluctuations in rotation observed for the photoconductive drums, fluctuations in transfer rate of the image carrier, the changes caused by a foreign factor such as the transfer sheet. The image forming device 100 forms a patch of toner patterns of respective colors on the image carrier, and detects the position of each pattern using the reflective sensor 24. Based on the detection results, the image forming apparatus calculates the shifts in each color, and feedback controls various image forming conditions such as light exposure timing.

Figure 2:
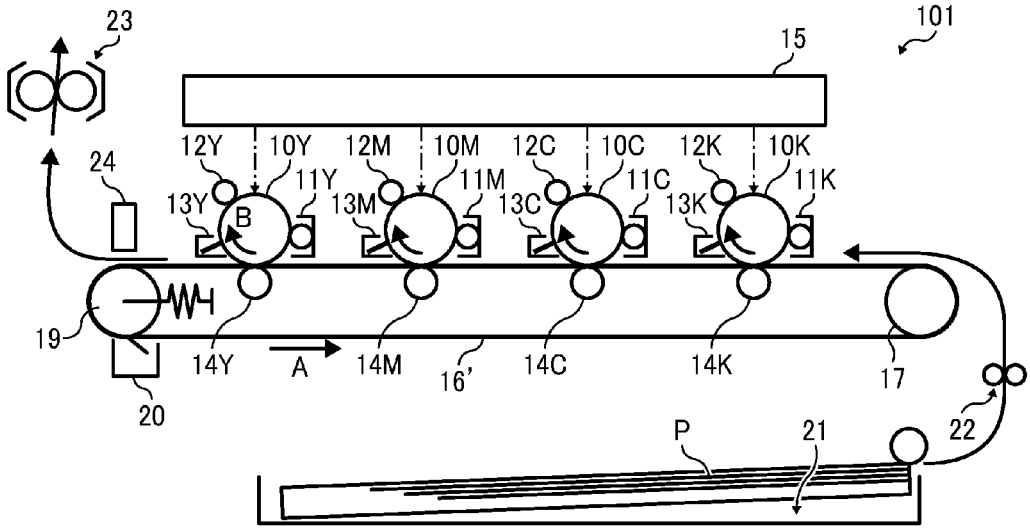
FIG. 2 is a cross-sectional view illustrating an image forming device of direct transfer type, which may be included in the color image forming apparatus, according to an example embodiment of the present invention.

FIG. 2 illustrates a structure of a tandem-type color image forming device 101 of direct transfer type. The image forming device 101 of FIG. 2 is provided in an image forming apparatus. The image forming device 101 uses a transfer belt 16', which functions as a transfer body that carries the transfer sheet P, to directly transfer toner images of respective colors of K, C, M, and Y. In the above-described case of image forming device 100 of FIG. 1, the images formed on the surfaces of the photoconductive drums 10 are transferred to the intermediate transfer belt 16 to form a full-color image thereon, and the full-color image is further transferred from the belt 16 onto the transfer sheet P. In this case of image forming device 101 of FIG. 2, the images formed on the surfaces of the photoconductive drums 10 are transferred directly to the transfer sheet P to form the full-color image thereon. As illustrated in FIG. 2, as the transfer sheet P carried by the transfer belt 16 is conveyed along the image forming units for respective colors of K, C, M, and Y, images of respective colors are transferred by the transfer rollers 14 one above the other such that the full-color image is formed on the transfer sheet P at the time when the transfer sheet P is conveyed to the position where the image forming unit of Y is provided. The transfer sheet P having the full-color image thereon is transferred to the fixing device 23 for fixing operation, and output to the outside of the image forming apparatus. In this example, the transfer belt 16' functions as the image carrier. For the descriptive purposes, any one of the intermediate transfer body, the transfer belt that may be provided in the image forming device 100, and the transfer belt 16', each functioning as the image carrier, is referred to as the image carrier 16.

Figure 3:
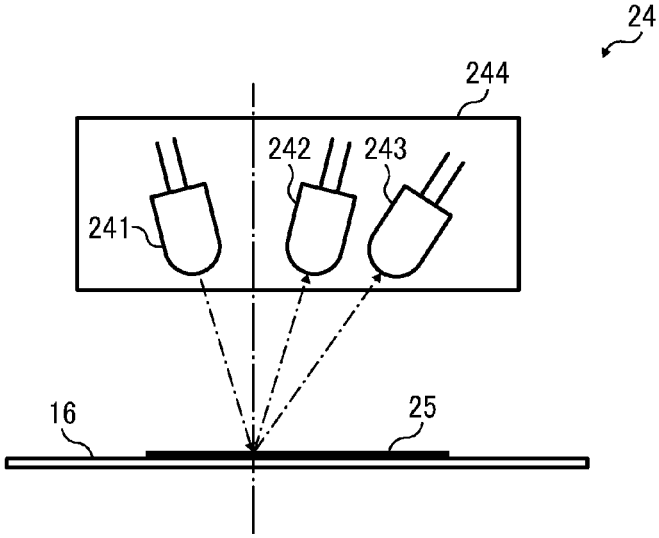
FIG. 3 is a schematic diagram illustrating a structure of a reflective sensor in the color image forming apparatus, according to an example embodiment of the present invention.

FIG. 3 illustrates an example structure of the reflective sensor 24. The reflective sensor 24 is located at a position that faces the image carrier 16 to detect a reflective light that is reflected from the toner pattern 25 formed on the surface of the image carrier 16. The reflective sensor 24 includes a light emitting element 241 such as an infrared light emitting diode, light receiving elements 242 and 243 each may be implemented by a phototransistor and a photodiode, and a holder 244 that accommodates therein the light emitting element 241 and the light receiving elements 242 and 243. The reflective sensor 24 is further provided with a processor circuit, which is mounted on a control circuit substrate on which the holder 244 is mounted. The processor circuit detects the density and the position of the toner pattern 25 for each color based on the output voltage signals respectively output from the elements 241 to 243.

The light receiving element 242 detects specular reflectance from the toner pattern 25. The light receiving element 243 detects diffuse reflectance from the toner pattern 25. Based on the detection signals output from the light receiving elements 242 and 243, the processor circuit is able to detect the density of the toner pattern 25 for the color K, and the colors C, M, and Y, in the range from low density to high density. In order to detect the position of the toner pattern 25 for each color, only the light receiving element 242 is used. As described below, the detection result of specular reflectance fluctuates due to deformation in the image carrier. The light receiving element 242 that detects specular reflectance is provided at a position such that its optical axis is symmetrical to a reflectance surface of the optical axis of the light receiving element 241. That is, for the light receiving element 241, the reflected angle and the output angle are the same with respect to the axis of symmetry. The light receiving element 244 that detects diffuse reflectance is arranged at a position not in line with the position where the optical axis is symmetrical such that the reflected angle and the output angle are not in line with respect to the axis of symmetry.

Figure 4:
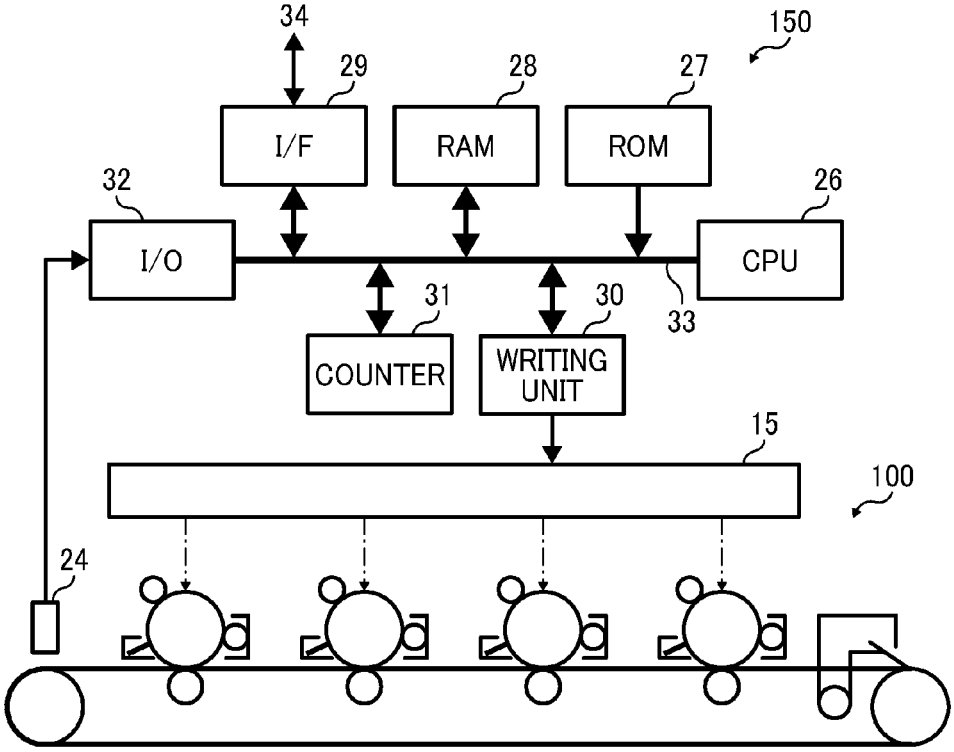
FIG. 4 is a schematic diagram illustrating a control section of the color image forming apparatus, which controls the image forming device of FIG. 1.

FIG. 4 illustrates a control section 150 of an image forming apparatus, which controls operation of the image forming device 100. The control section 150 includes a central processing unit (CPU) 26, a read only memory (ROM) 27, a random access memory (RAM) 28, an interface (I/F) 29, a writing unit 30, a counter 31, and an input/output (I/O) 32, which are connected through a bus 33. These devices function as computer resources.

The CPU 26 deploys a control program stored in the ROM 27 onto the RAM 28. The CPU 26 controls entire operation of the image forming device 100 using the RAM 28 as a work area or a data buffer. The RAM 28 functions as a work area for the CPU 26 or a memory space for storing various parameters. The I/F 29 is connected to an external device 34 such as a wired LAN, wireless LAN, or USB, to allow exchange of data with the external device 34. When the I/F 29 receives data from the external device 34, the writing unit 30 sends image digital signals of respective colors of Y, M, C, and K to the exposure device 15 as writing signals, according to various parameters regarding toner density or color shift stored in the RAM 28.

In operation of controlling toner density and color shifts, the CPU 26 causes the writing unit 30 and the exposure device 15 to form the toner pattern 25, which is used for toner density and color shift detection, on the surface of the image carrier 16 at a timing specified by data stored in the RAM 28. At this time, the image carrier 16, such as the intermediate transfer belt 16, is rotated at a constant speed. The reflective sensor 24 outputs a detection result indicating the toner density and the color shift, and inputs the detection result to the I/O 32. Based on the detection result, the CPU 26 calculates correction parameters, and stores the calculated correction parameters in the RAM 28. After storing the correction parameters, the CPU 26 prepares for next image forming operation. The counter 31 counts a number of toner patterns formed on the image carrier 16, as well as a time period specifying a pitch between the toner patterns formed on the image carrier 16.

Figure 5:
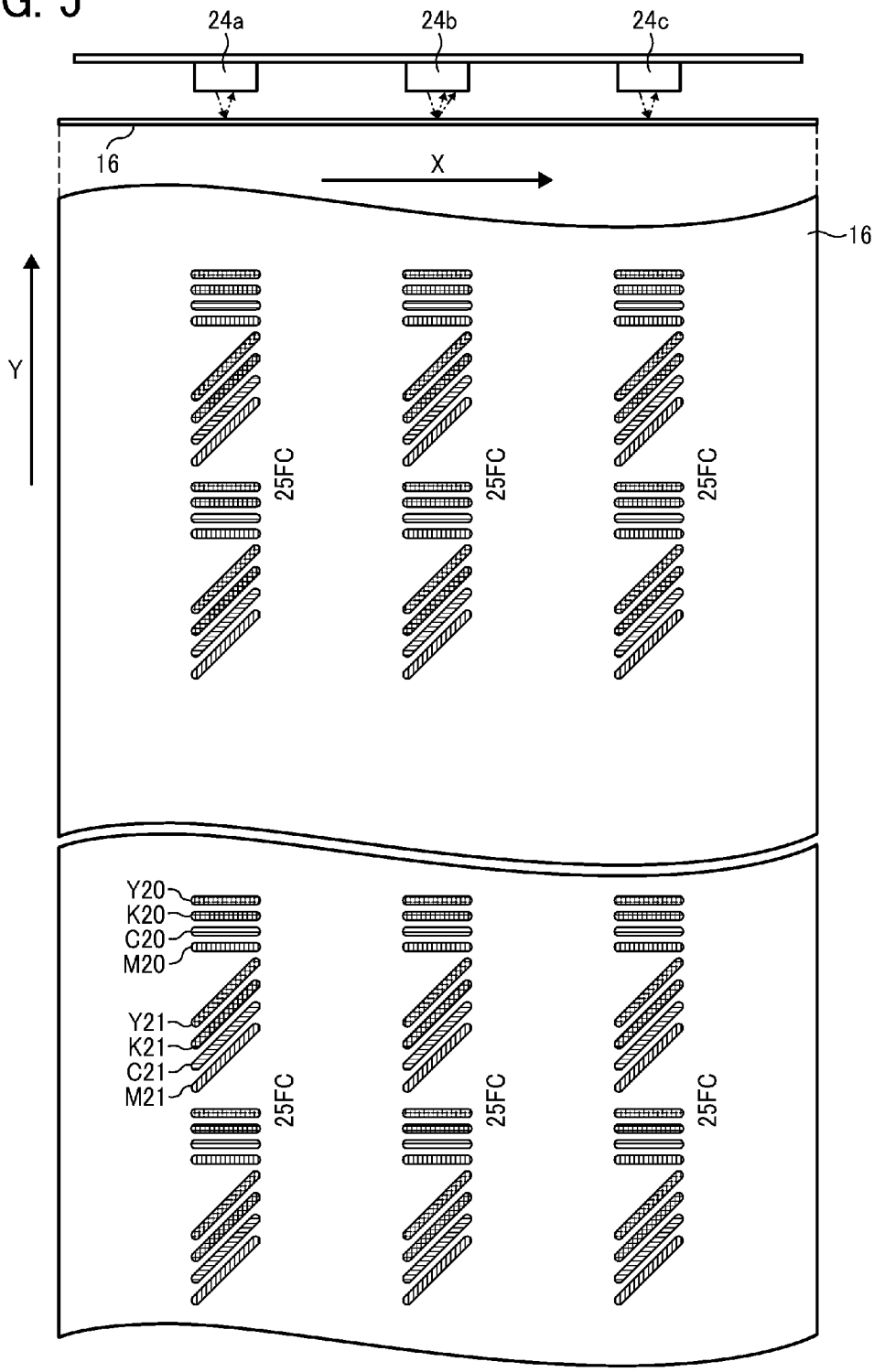
FIG. 5 is an illustration for explaining the relative positions of toner patterns formed on an image carrier with respect to the reflective sensor of FIG. 3.

FIG. 5 illustrates the positional relationship between the toner patterns 25 formed on the image carrier 16 and the reflective sensor 24 according to an example embodiment of the present invention. Although not illustrated in FIG. 5, the image carrier 16 is further formed with toner patterns Y1 to Y10 that together represent tone of yellow, toner patterns K1 to K10 that together represent tone of black, C1 to C10 that together represent tone of cyan, and M1 to M10 that together represent tone of magenta. These toner patterns, which may be collectively referred to as a patch, are used to control image density. In this example, the toner patterns for image density are formed in prior to forming of the toner patterns for color shift correction illustrated in FIG. 5. For example, the toner patterns Y1 to Y10 specify an image density ranging from 10% to 100% according to a predetermined condition. Based on the detection result of the reflective sensor 24, the CPU 26 calculates an image density from the detection result, and adjusts various processing conditions based on the calculated image density.

Referring to FIG. 5, the toner patterns 25 for color shift correction are formed, respectively, on a central section of the image carrier 16 and on both ends of the image carrier 16. The reflective sensor 24*a*, 24*b*, and 24*c* each detect specular reflectance from the toner patterns 25. In this example, the toner patterns for color shift correction are each formed as a full color toner pattern 25FC, in which rectangular patterns of Y, K, C, and M are arranged side by side. Further, the rectangular patterns include a group of rectangular patterns each are parallel to the main scanning direction X, and a group of rectangular patterns each are tilted with respect to the main scanning direction X, for example, at an angle of 45 degrees. Using the group of rectangular patterns that are parallel to the main scanning direction X, the color shift in the transfer direction Y that is perpendicular to the main scanning direction X is detected based on the positional relationship of the pattern of each color of Y, C, and M with respect to the pattern of K. Using the group of tilted rectangular patterns, the color shift in the main scanning direction X is detected based on the positional relationship of the pattern of each color of Y, C, and M with respect to the pattern of K. More specifically, in this example, the counter 31 counts a time period required for each pattern to be transferred to a predetermined position, such as a position where the sensor 24 is provided, to obtain a counter value. The positional relationship is detected based on the counter value.

The CPU 26 detects a color shift from the counter value of the counter 31. Based on the detected color shift, the writing unit 30 controls an image writing signal, or a timing for writing. The toner patterns 25 formed on the surface of the image carrier 16 are transferred in the transfer direction of the image carrier 16. When the toner patterns 25 are conveyed to a position right below the reflective sensor 24, the reflective sensor 24, i.e., the reflective sensors 24*a*, 24*b*, and 24*c*, each detect the toner patterns 25. The reflective sensors 24*a*, 24*b*, and 24*c* are arranged, side by side, in the direction that is perpendicular to the transfer direction of the image carrier 16. When viewed from the front-side of the image forming apparatus, the reflective sensors 24*a*, 24*b*, and 24*c* respectively detect the toner patterns 25 formed at the front end, the toner patterns 25 formed on the central section, and the toner patterns 25 formed on the back end.

Figure 6:
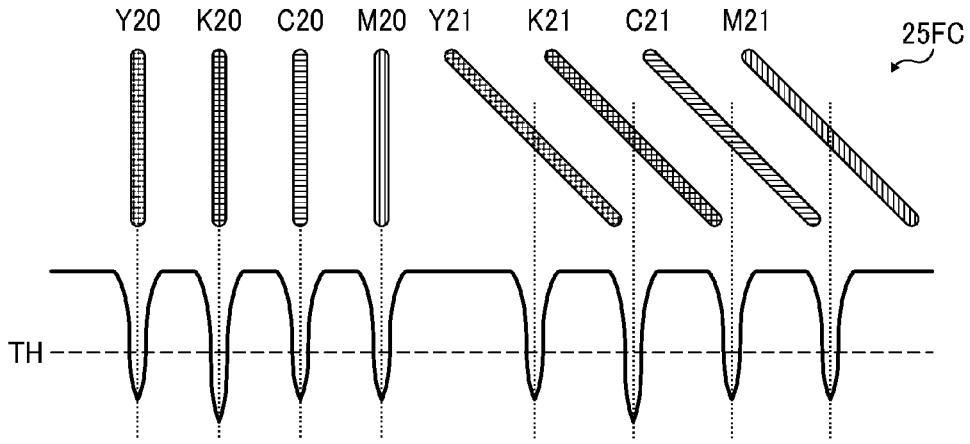
FIG. 6 illustrates a timing chart of the waveforms of specular reflectance output by the reflective sensor when the full-color toner patterns of FIG. 5 are detected.

FIG. 6 is a timing chart illustrating the output waveforms of specular reflectance detected by the reflective sensor 24, when the reflective sensor 24 detects the full-color patterns 25FC for color shift correction illustrated in FIG. 5. In case of toner patterns for density correction, the output voltage levels of the toner density patterns are supposed to gradually decrease according to the tone, or gradation, of the toner density patterns. To detect the toner density, amplitude of the output voltage waveform is detected. In case of toner patterns for color shift correction, the output voltage level of the black toner pattern tends to be lower as the black K has low reflectance. The output voltage level of the toner pattern of each of colors Y, M, and C tends to be stable. When the color shift is detected, the intersected point of the trailing edge with a threshold TH and the intersected point of the rising edge with the threshold TH are added to obtain the summed value. This summed value is divided by 2 to obtain a center value. In FIG. 6, the center value is a value, or a counter value, that is indicated by the line perpendicular to the line specified by the threshold TH.

Figure 7:
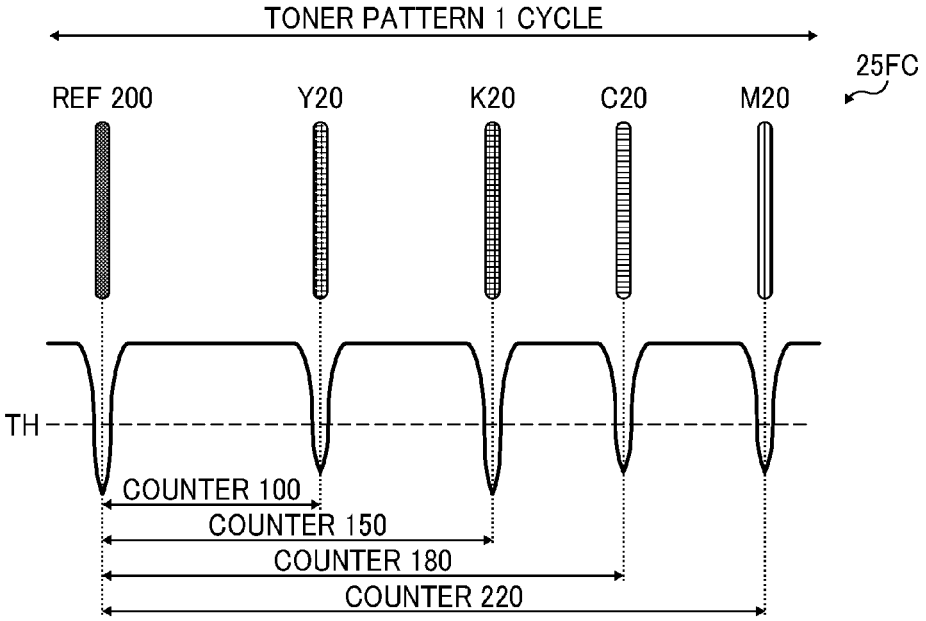
FIG. 7 illustrates a timing chart of the waveforms of specular reflectance output by the reflective sensor when the full-color toner patterns of one cycle is detected, and counter values obtained for the waveforms of specular reflectance with respect to the reference pattern.

FIG. 7 is a timing chart illustrating the output waveforms of specular reflectance detected by the reflective sensor 24, when the reflective sensor 24 detects the full-color toner patterns 25FC for color shift correction for one cycle. In this example, one cycle of toner patterns corresponds to a time period between the time when the output waveform for the reference toner pattern 200 for the reference color (black) is detected and the time when the output waveform for the last toner pattern M20 for magenta is detected. The reflective sensor 24 outputs the waveforms of FIG. 7, when the reflective sensor 24 detects specular reflectance from the toner patterns 25FC for one cycle of toner patterns. Based on the waveforms, the counter values are obtained for the toner patterns. More specifically, the center value is obtained from the reference toner pattern 200, by dividing the total of the interception of the trailing edge with the threshold TH and the interception of the rising edge with the threshold TH by 2. The center value is obtained from each of the following toner patterns Y20 to M20 in a substantially similar manner. The counter 31 starts counting a time period from the central value for the reference toner pattern 200 to the central value for the yellow toner pattern Y20 to obtain a counter value 100, and stores the counter value 100 in the RAM 28. This is repeated for each of the toner patterns.

In this example illustrated in FIG. 7, the counter value obtained from the reference pattern 200 to the yellow pattern Y20 is 100. The counter values obtained from the reference pattern 200 to the black pattern K20, the cyan pattern C20, and the magenta pattern M20 are respectively 150, 180, and 220. In this example, the full-color toner patterns are formed only once after the power of the image forming apparatus having the image forming device 100 is turned on. When the full-color toner patterns are formed, the counter values are obtained and stored.

Figure 8:
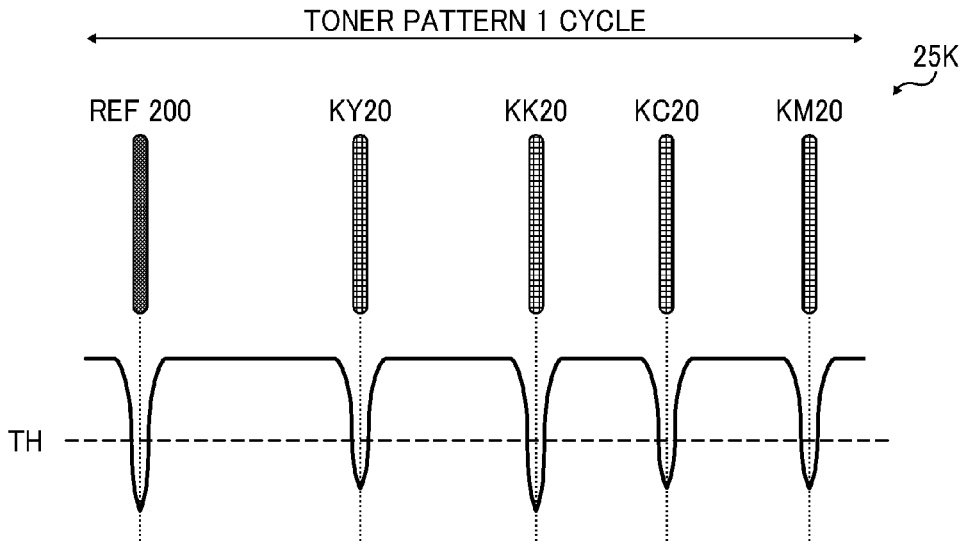
FIG. 8 illustrates a timing chart of the waveforms of specular reflectance output by the reflective sensor when a black toner patterns of one cycle is detected.

FIG. 8 is a timing chart illustrating the output waveforms of specular reflectance detected by the reflective sensor 24, when the reflective sensor 24 detects the toner patterns 25K for the black color for one cycle. In this example, the image forming device 100 performs color shift correction using the toner patterns 25K for the black color illustrated in FIG. 8 in replace of the full-color toner patterns 25FC illustrated in FIG. 7. Since the toner patterns for the black color are formed for color shift correction, color toner consumption is reduced. More specifically, in FIGS. 7 and 8, the yellow toner pattern Y20, the black toner pattern K20, the cyan toner pattern C20, and the magenta toner pattern M20 are respectively replaced by the black toner pattern KY20, the black toner pattern KK20, the black toner pattern KC20, and the black toner pattern KM20.

Figure 9:
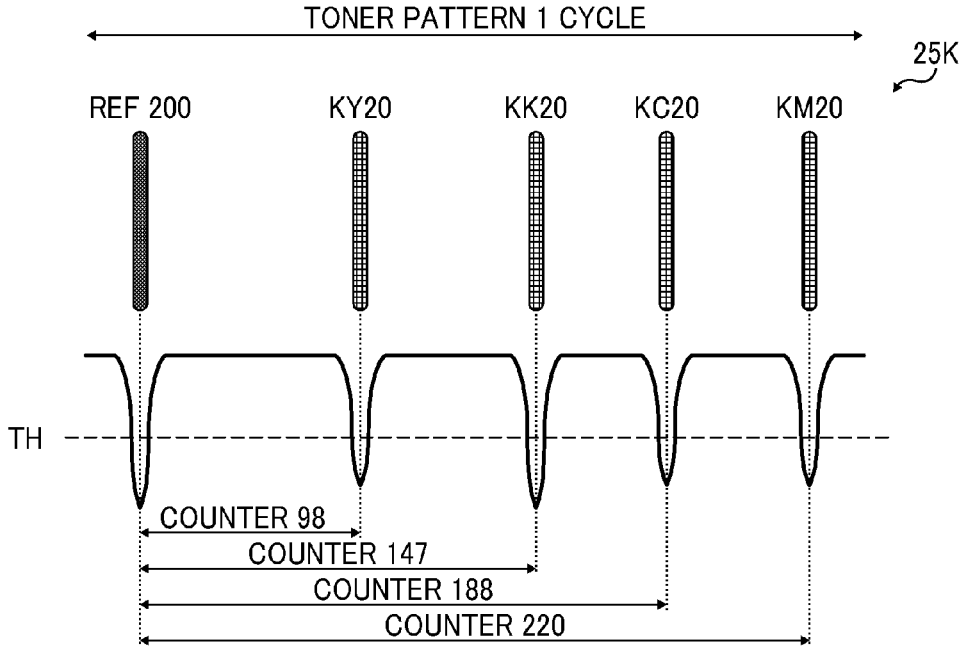
FIG. 9 is an illustration for explaining counter values obtained for the waveforms of specular reflectance of FIG. 8 with respect to the reference pattern.

FIG. 9 illustrates the output waveforms of specular reflectance detected by the reflective sensor 24 when the toner patterns 25K are detected, and counter values that are obtained from the time when the reference pattern is detected to the time when each toner pattern is detected. The image forming device 100 generates and detects the black toner patterns 25K, for example, after the full-color toner patterns 25FC are formed at the time when the power of the image forming apparatus is turned on. The CPU 26 applies color shift correction to the image forming device 100 such that the K toner pattern 25K has a pitch that is substantially the same as the pitch of the toner pattern illustrated in FIG. 7. More specifically, the CPU 26 causes the pitch between the reference pattern 200 and the pattern KY20 to be equal to the pitch between the reference pattern 200 and the yellow pattern Y20 of FIG. 7, the pitch between the reference pattern 200 and the pattern KK20 to be equal to the pitch between the reference pattern 200 and the black pattern K20, the pitch between the reference pattern 200 and the pattern KC20 to be equal to the pitch between the reference pattern 200 and the cyan pattern C20, and the pitch between the reference pattern 200 and the pattern KM20 to be equal to the pitch between the reference pattern 200 and the magenta pattern M20.

In this example case illustrated in FIG. 9, the counter values based on the detected results of the reflective sensor 24 are 98 for the pitch between the reference pattern 200 and the pattern KY20, 147 for the pitch between the reference pattern 200 and the pattern KK20, 188 for the pitch between the reference pattern 200 and the pattern KC20, 220 for the pitch between the reference pattern 200 and the pattern KM20. The CPU 26 controls the image forming device 100 to form toner patterns such that the pitch of each toner pattern is the same between the case illustrated in FIG. 7 and the case illustrated in FIG. 9. However, the counter values specifying the pitch between the reference pattern and each toner pattern illustrated in FIG. 9 are different from the counter values specifying the pitch between the reference pattern and each toner pattern illustrated in FIG. 7. This difference in the counter values between FIG. 7 and FIG. 9 corresponds to the difference in pitch between the color toner pattern 25FC and the K toner pattern 25K, which cannot be controlled or calculated by the CPU 26. For example, this difference may be caused due to the eccentricity or fluctuations in rotation between the K color photoconductive drum 10K and any one of the color photoconductive drum 10Y, 10M, and 10C. The CPU 26 calculates the difference in pitch between the color toner pattern 25FC and the K toner pattern 25K, and stores the calculated difference in the RAM 28. In the following, the calculated difference is referred to as the "toner pattern difference parameter FC−K DIFF". This difference is obtained for the other colors of Y, C, and M such that the toner pattern difference parameters FC(Y)−K, FC(C)−K, and FC(M)−K are respectively obtained.

Figure 10:
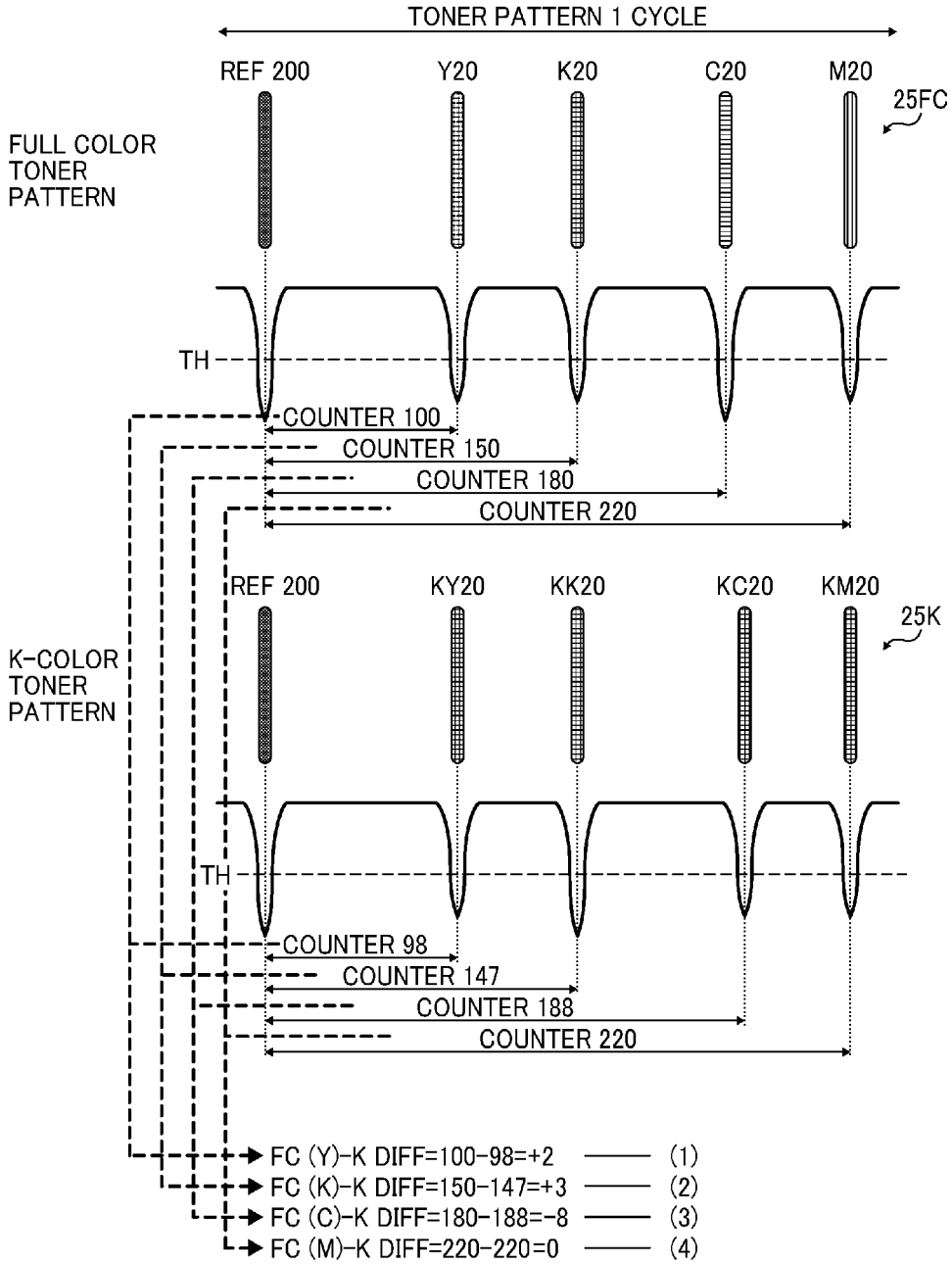
FIG. 10 is an illustration for explaining calculation of error parameters based on the detected toner patterns.

FIG. 10 is an illustration for explaining operation of calculating the toner pattern difference parameters FC−K DIFF for each colors. In this example, the CPU 26 calculates the difference between the counter values 100, 150, 180, and 220 obtained for the full-color toner pattern 25FC, and the counter values 90, 147, 188, and 220 obtained for the K toner pattern 25K. The equation (1) of FIG. 10, expressed as FC(Y)−K DIFF=100−98=2, is a value obtained by subtracting the counter value 98 specifying the pitch between the reference pattern 200 and the pattern KY20 of the K toner pattern 25K, from the counter value 100 specifying the pitch between the reference pattern 200 and the pattern Y20 of the full-color toner pattern 25FC.

In a substantially similar manner, as illustrated in FIG. 10, the equations 2, 3, and 4 are obtained as follows.

$$FC(K)-K\text{DIFF}=150-147=3. \quad \text{Equation 2:}$$

$$FC(C)-K\text{DIFF}=180-188=-8. \quad \text{Equation 3:}$$

$$FC(M)-K\text{DIFF}=220-220=0. \quad \text{Equation 4:}$$

Figure 11:
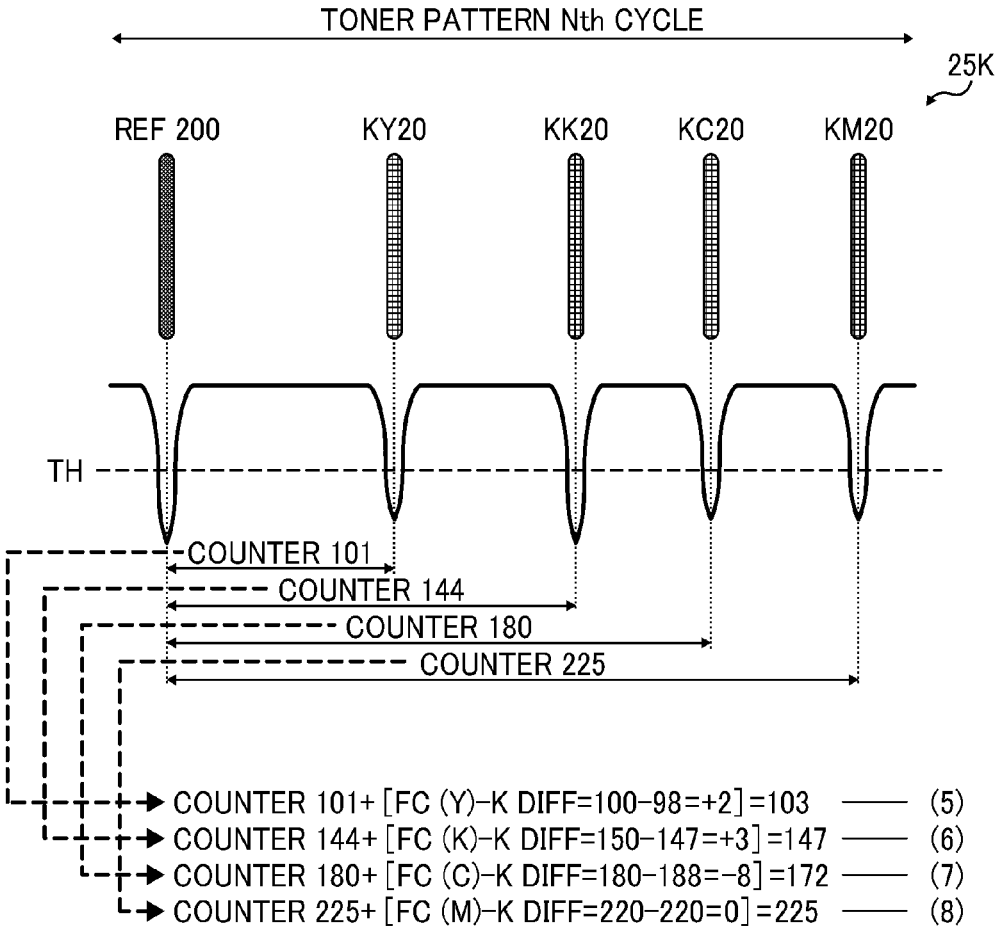
FIG. 11 is an illustration for explaining color shift correction, performed by the control section of the color image forming apparatus according to an example embodiment of the present invention.

FIG. 11 is an illustration for explaining color shift correction according to an example embodiment of the present invention. In this example, the CUP 26 performs color shift correction based on the toner pattern difference parameters FC−K, which are obtained using the K toner pattern 25K. FIG. 11 illustrates a toner pattern for Nth cycle, which is generated after repeating image forming operation following detection of toner patterns illustrated in FIG. 9. As the image forming operation is repeated, the counter values specifying the pitch between the toner patterns detected by the reflective sensor 24 may change due to the physical change such as deformation of the image carrier 16. In the background technique of color shift correction using the full-color toner pattern, the counter values are used as the parameters to feedback to perform color shift correction. In this example, the toner pattern difference parameters FC−K DIFF illustrated in FIG. 10 are added, respectively, to the counter values of the black toner patterns 25K that correspond to the respective colors, as follows.

$$\text{Counter value } 101+\text{Solution to Equation (1)}=101+2=103\ (=\alpha). \quad \text{Equation 5:}$$

$$\text{Counter value } 144+\text{Solution to Equation (2)}=144+3=147\ (=\alpha). \quad \text{Equation 6:}$$

$$\text{Counter value } 180+\text{Solution to Equation (3)}=180-8=172\ (=\alpha). \quad \text{Equation 7:}$$

$$\text{Counter value } 225+\text{Solution to Equation (4)}=225+0=225\ (=\alpha). \quad \text{Equation 8:}$$

Using the added values obtained as described above as correction parameters $\alpha$, the CPU 26 performs color shift correction. As indicated by the equations 5 to 8 and illustrated in FIG. 11, the correction parameters $\alpha$ are 103, 147, 172, and 225, respectively, for the colors Y, K, C, and M. These correction parameters $\alpha$ are used to feedback control various image forming conditions to suppress color shifts in images, thus improving the image quality.

As described above, the toner pattern difference parameter FC−K DIFF is the difference between the full-color toner pattern 25FC and the K toner pattern 25K. With the parameters $\alpha$ specified by any one of the equations 5 to 8, in case the full-color toner pattern 25FC is formed for the Nth cycle for sensor detection, the counter value for the full-color toner pattern 25FC would be equal to the counter value obtained for the K toner pattern 25K. Accordingly, color shift correction can be performed using the correction parameters $\alpha$, which are obtained using the K toner patterns 25K in replace of the full-color toner patterns 25FC.

In this example, a patch of full-color toner patterns 25FC is formed only once after the power of the image forming apparatus is turned on. Alternatively, the patch of full-color toner patterns 25FC may be formed when it is preferable to reset the toner pattern difference parameter FC−K DIFF based on detection of toner patterns, for example, when it is determined that the color shift may be affected. For example, it is determined that the color shift may be affected when the intermediate transfer belt is installed or uninstalled, the photoconductive drum is installed or uninstalled, the drive motor of the intermediate transfer belt is installed or uninstalled, or the drive motor of the photoconductive drum is installed or uninstalled. In this manner, the color shift correction can be performed with improved accuracy even when the above-described case occurs.

Figure 12:
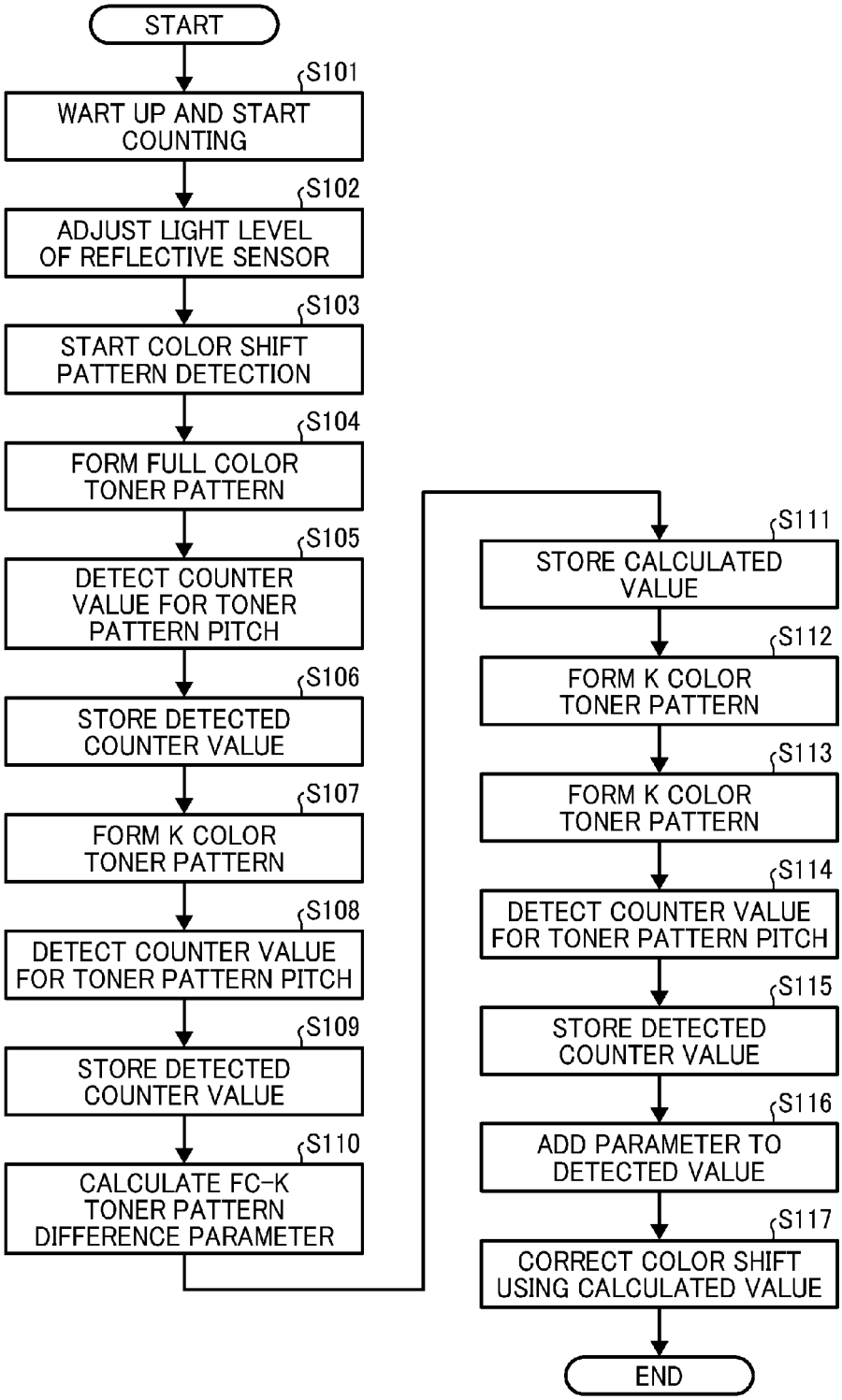
FIG. 12 is a flowchart illustrating operation of applying color shift correction, performed by the control section of the color image forming apparatus, according to an example embodiment of the present invention.

FIG. 12 is a flowchart illustrating operation of applying color shift correction, performed by the CPU 26, according to an example embodiment of the present invention. The operation of FIG. 12 may be performed, for example, when the power of the image forming apparatus is turned on.

At S101, as the image forming apparatus starts warm-up operation, the CPU 24 causes the counter 31 to start counting.

At S102, the CPU 24 adjusts light emittance levels of the light emitting elements 241 of the reflective sensors 24*a*, 24*b*, and 24*c*.

At S103, the CPU 24 starts detection of toner patterns for color shift correction.

At S104, the CPU 24 forms the full-color toner patterns 25FC on the surface of the image carrier 16, as illustrated in FIG. 6. In case of image forming device 100 of intermediate transfer type as illustrated in FIG. 1, the toner patterns are formed on the intermediate transfer belt 16. In case of image forming device 200 of direct transfer type as illustrated in FIG. 2, the toner patterns are formed on the transfer belt 16'.

At S105, the CPU 24 detects a counter value indicating the pitch of each toner pattern as illustrated in FIG. 7, based on detection results output by the sensor 24.

At S106, the CPU 24 stores the detected counter values of the full-color toner patterns 25FC in the RAM 28.

At S107, the CPU 24 forms toner patterns 25K of K color on the surface of the image carrier 16, as illustrated in FIG. 8.

At S108, the CPU 24 detects a counter value indicating the pitch of each toner pattern as illustrated in FIG. 9, based on detection results output by the sensor 24.

At S109, the CPU 24 stores the detected counter values of the K color toner patterns 25K in the RAM 28.

At S110, the CPU 24 calculates a toner pattern difference parameter FC−K DIFF for each color as illustrated in FIG. 10, using the counter values stored at S106 and the counter values stored at S109. More specifically, the CPU 24 obtains the difference between the counter value stored in the RAM 28 at S106 and the counter value stored in the RAM 28 at S109.

At S111, the CPU 24 stores the calculation result obtained at S110 in the RAM 28.

The following steps are performed to correct color shifts using the toner patterns 25K of black color.

At S112 and S113, the CPU 24 forms a toner pattern 25K for color K.

At S114, the CPU 24 detects a counter value indicating a pitch between the toner patterns formed at S112 and S113, based on a detection result output by the sensor 24.

At S115, the CPU 24 stores the detected counter value obtained at S114 in the RAM 28.

At S116, the CPU 24 adds the counter value stored in the RAM 28 at S115 with the difference parameter FC−K DIFF that is calculated and stored at S110 and S111 to obtain an added value. The added value may be referred to as a correction parameter.

At S117, the CPU 24 performs color shift correction based on the added value, or the correction parameter, obtained at S116.

As described above, as long as full-color toner patterns 25FC are formed once at the time of turning on the power, the image forming apparatus is able to perform color shift correction using the toner patterns 25K of black color. Since formation of full-color toner patterns are only needed basically at the time when the power is turned on, color toner consumption is greatly reduced.

Further, in the above-described example, the toner patterns used for color shift correction include the full-color toner patterns 25FC and the K color toner patterns 25K. Further, the above-described color shift correction may be performed by any one of the image forming devices 100 and 101, or an image forming apparatus having any one of the image forming devices 100 and 101.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

For example, the image forming apparatus may be a copier or a printer. Further, the image forming apparatus may be implemented by a multifunctional product (MFP) capable of performing a plurality of image processing functions including facsimile communication, data communication, etc., in addition to copying and/or printing.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, involatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

In one example, the present invention may reside in an image forming apparatus to form a color image by superimposing images of a plurality of colors one above the other. The image forming apparatus includes: means for forming a plurality of patterns using the plurality of colors as a first pattern; means for forming a plurality of patterns using one of the plurality of colors as a second pattern, the plurality of patterns of the second pattern each configured to be formed at a pitch substantially the same with a pitch of corresponding one of the plurality of patterns of the first pattern; means for obtaining a first detection result indicating the pitch of each one of the plurality of patterns of the first pattern; means for obtaining a second detection result indicating the pitch of each one of the plurality of patterns of the second pattern; means for calculating a difference between the first detection result and the second detection result to obtain a difference value; and means for obtaining a correction value using the second detection result and the difference value, and applying color shift correction based on the correction value.

The means for forming the first pattern forms the first pattern at a previously determined time, and the means for forming the second pattern forms the second pattern after the previously determined time.

The previously determined time includes at least one of: time after the power of the image forming apparatus is turned on; time after an image carrier is installed or removed; time after a photoconductor is installed or removed; time after a drive motor of the image carrier is installed or removed; and time after a drive motor of the photoconductor is installed or removed.

The image forming apparatus further includes means for optically detecting the first pattern and the second pattern to output detection results, wherein the first detection result and the second detection result are obtained from counter values based on the detection results.

The first pattern and the second pattern are formed on a surface of the image carrier. The image carrier includes one of an intermediate transfer member such as an intermediate transfer belt, and a transfer member such as a transfer belt.

As described above, the image forming apparatus calculates a correction value of the second pattern with respect to the first pattern based on the first and second detection results, and applies color shift correction based on the correction value.

For example, when the second pattern is formed with a black color, color toner consumption for color shift correction is greatly reduced as the full-color toner pattern does not have to be formed so often.

What is claimed is:

1. An image forming apparatus to form a color image by superimposing images of a plurality of colors one above the other, the apparatus comprising:

an image forming device to form a plurality of patterns on a surface of an image carrier using the plurality of colors as a first pattern, and to form a plurality of patterns on the surface of the image carrier using one of the plurality of colors as a second pattern, the plurality of patterns of the second pattern each configured to be formed at a pitch substantially the same with a pitch of corresponding one of the plurality of patterns of the first pattern;

a detector to obtain a first detection result indicating the pitch of each one of the plurality of patterns of the first pattern, and to obtain a second detection result indicating the pitch of each one of the plurality of patterns of the second pattern; and a controller to calculate a difference between the first detection result and the second detection result to obtain a difference value, to calculate a correction value using the second detection result and the difference value, and to control the image forming device according to the correction value to suppress color shifts in the images.

2. The image forming apparatus of claim 1, further comprising:

a sensor to optically detect the first pattern and the second pattern to output detection results, wherein the detector generates counter values based on the detection results output from the sensor, and obtains the first detection result and the second detection result based on the counter values.

3. The image forming apparatus of claim 2, wherein:

the image forming device is further configured to form a reference pattern, and the pitch of each one of the plurality of patterns of the first pattern and the second pattern are respectively obtained with respect to the reference pattern.

4. The image forming apparatus of claim 3, wherein the one of the plurality of colors is a black color.

5. The image forming apparatus of claim 4, wherein:

the image forming device forms the first pattern at a previously determined time, and the second pattern after the previously determined time.

6. The image forming apparatus of claim 5, wherein the previously determined time includes at least one of:

time when the power of the image forming apparatus is turned on;

time when the image carrier is installed or removed;

time when a photoconductor of the image forming device is installed or removed;

time when a drive motor of the image carrier is installed or removed; and time when a drive motor of the photoconductor is installed or removed.

7. The image forming apparatus of claim 6, wherein the image carrier includes one of an intermediate transfer member and a transfer member.

8. A method of applying color shift correction to an image forming apparatus to form a color image by superimposing images of a plurality of colors one above the other, the method comprising:

forming a plurality of patterns using the plurality of colors as a first pattern;

forming a plurality of patterns using one of the plurality of colors as a second pattern, the plurality of patterns of the second pattern each configured to be formed at a pitch substantially the same with a pitch of corresponding one of the plurality of patterns of the first pattern;

obtaining a first detection result indicating the pitch of each one of the plurality of patterns of the first pattern;

obtaining a second detection result indicating the pitch of each one of the plurality of patterns of the second pattern;

calculating a difference between the first detection result and the second detection result to obtain a difference value;

calculating a correction value using the second detection result and the difference value; and controlling the image forming apparatus according to the correction value to suppress color shifts in the images.

9. The method of claim 8, further comprising:

optically detecting the first pattern and the second pattern to output detection results;

generating counter values based on the output detection results, wherein the first detection result and the second detection result are obtained based on the counter values.

10. The method of claim 9, further comprising:

forming a reference pattern, wherein the pitch of each one of the plurality of patterns of the first pattern and the second pattern are respectively obtained with respect to the reference pattern.

11. The method of claim 10, wherein the one of the plurality of colors is a black color.

12. A non-transitory recording medium storing a plurality of instructions which cause a processor to perform a method of applying color shift correction to an image forming apparatus to form a color image by superimposing images of a plurality of colors one above the other, the method comprising:

forming a plurality of patterns using the plurality of colors as a first pattern;

forming a plurality of patterns using one of the plurality of colors as a second pattern, the plurality of patterns of the second pattern each configured to be formed at a pitch substantially the same with a pitch of corresponding one of the plurality of patterns of the first pattern;

obtaining a first detection result indicating the pitch of each one of the plurality of patterns of the first pattern;

obtaining a second detection result indicating the pitch of each one of the plurality of patterns of the second pattern;

calculating a difference between the first detection result and the second detection result to obtain a difference value;

calculating a correction value using the second detection result and the difference value; and controlling the image forming apparatus according to the correction value to suppress color shifts in the images.

* * * * *